US007083535B1

(12) United States Patent
Robinson

(10) Patent No.: US 7,083,535 B1
(45) Date of Patent: Aug. 1, 2006

(54) MULTI-PURPOSE GOLF TOOL

(76) Inventor: Melvin D. Robinson, 11 Ontur La., Hot Springs Village, AR (US) 71909

( * ) Notice: Subject to any disclaimer, the term of this patent is extended or adjusted under 35 U.S.C. 154(b) by 267 days.

(21) Appl. No.: 10/367,449

(22) Filed: Feb. 14, 2003

(51) Int. Cl.
*A63B 57/00* (2006.01)

(52) U.S. Cl. ..... 473/408; 473/406

(58) Field of Classification Search ..... 473/408, 473/406; 224/918; 101/DIG. 40, 35–41
See application file for complete search history.

(56) References Cited

U.S. PATENT DOCUMENTS 3,019,762 A * 2/1962 Hautz ..... 401/78
5,054,777 A * 10/1991 Borden et al. ..... 473/408
5,743,180 A * 4/1998 Arnke ..... 101/35
6,030,298 A * 2/2000 Tate ..... 473/408
6,050,905 A * 4/2000 Tate ..... 473/408
6,491,594 B1 * 12/2002 Dacosta ..... 473/408

* cited by examiner

*Primary Examiner*—Steven Wong

(57) ABSTRACT

A multi-purpose golf tool that includes a club handle support, a two-pronged ball mark repair tool, an attachment clip, a ball marking structure, an ink reservoir for supplying the ball marking structure, and a ball position marking disk structure.

1 Claim, 3 Drawing Sheets

MULTI-PURPOSE GOLF TOOL

TECHNICAL FIELD

The present invention relates to golf accessories and more particularly to a multi-purpose golf tool that includes a tool outer shell having a club handle structure formed therein for supporting a section of a golf club handle on a recessed area of the tool outer shell, two ground insertion spikes (extending from the base of the tool), outer tool shell attachment clip secured to the tool outer shell and adapted to be, (secured over the edge of a waist band or belt) a ball marker storage structure formed in carried on the tool outer shell, an absorbent ink reservoir member contained within a sealable interior cavity within the tool outer shell, and a raised golf ball printing structure having a curved golf ball printing pad mounted within a curved holding structure formed within the tool outer shell tint that is adapted to hold the curved golf ball printing pad in ink receiving connection with the absorbent ink reservoir member; the tool outer shell including a bottom shell portion and an outer shell cap portion seal ably connectable to the bottom shell portion by an O-ring positioned around the circumference of the raised golf ball printing structure; the two ground insertion spikes extending from a bottom surface of the bottom shell portion; the outer shell cap portion having a top cap surface defining the club handle saddle structure; the ball marker storage structure including a magnet positioned on only a portion of the bottom surface of a marker receiving cavity of the ball marker storage structure is a manner to provide a holding force for holding a metal ball marker in the ball marker holding structure when it is not in use.

BACKGROUND ART

Golfers typically use a variety of accessories during play of a round of golf. It would be desirable, therefore, to have a multi-purpose golf tool that includes a number of accessories and tools in a single unit that could be easily attached to a player's waistband, golf bag or belt.

GENERAL SUMMARY DISCUSSION OF INVENTION

It is thus an object of the invention to provide a multi-purpose golf tool that includes a tool outer shell having a club handle saddle structure formed therein for supporting a section of a golf club handle on a recessed area of the tool outer shell, two ground insertion spikes extending the tool outer shell, an outer tool shell attachment clip secured to the tool outer shell and adapted to be, (secured over the edge of a waist band or belt), a ball marker storage structure formed in carried on the tool outer shell, an absorbent ink reservoir member contained within a sealable interior cavity within the tool outer shell, and a raised golf ball printing structure having a curved golf ball printing pad mounted within a curved holding structure formed within the tool outer shell that is adapted to hold the curved golf ball printing pad in ink receiving connection with the absorbent ink reservoir member; the tool outer shell including a bottom shell portion and an outer cap portion and an outer shell cap portion sealably connectable to the bottom shell portion by an O-ring positioned around the circumference of the raised golf ball printing structure; the two ground insertion spikes extending from a bottom surface of the bottom shell portion; the outer shell cap portion having a top cap surface defining the club handle saddle structure; the ball marker storage structure including the magnet positioned on only a portion of the bottom surface of a marker receiving cavity of the ball marker storage structure in a manner to provide a holding force for holding a metal ball marker in the ball marker holding structure when not in use.

Accordingly, a multi-purpose golf utility tool provided.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
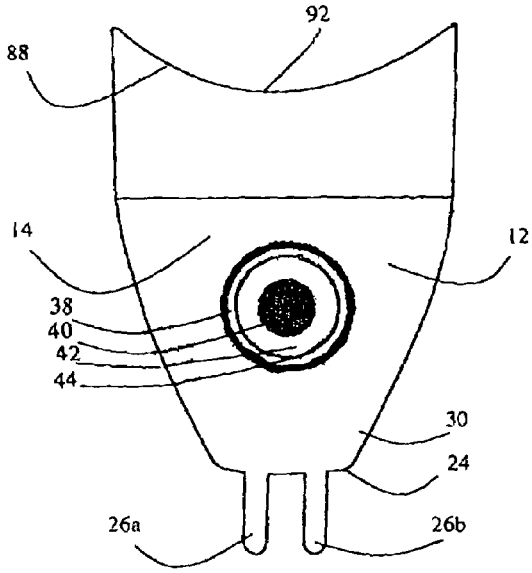
FIG. 1 is a perspective view of an exemplary embodiment of the multi-purpose golf tool of the present invention with the ball marker removed from its storage structure on the bottom section tool outer shell.
Figure 2:
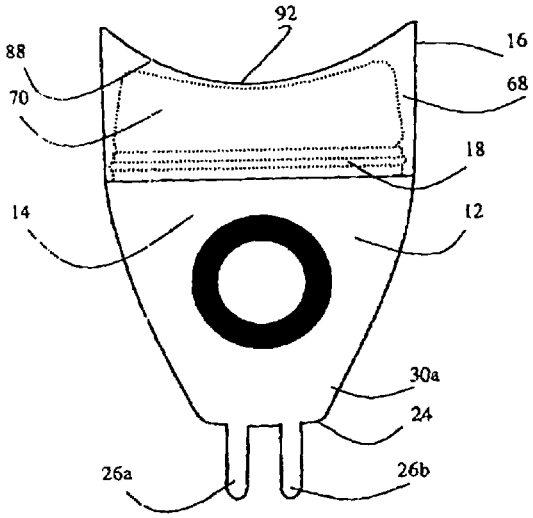
FIG. 2 is a side plan view of the multi-purpose golf tool of FIG. 1 showing the attachment clip provided on the bottom section of the tool outer shell.
Figure 3:
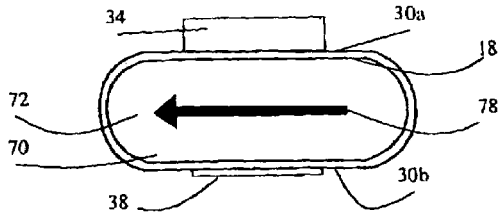
FIG. 3 is a top plan view of view of the multi-purpose golf tool of FIG. 1 with the removable top cap removed to reveal the golf ball printing structure.
Figure 5:
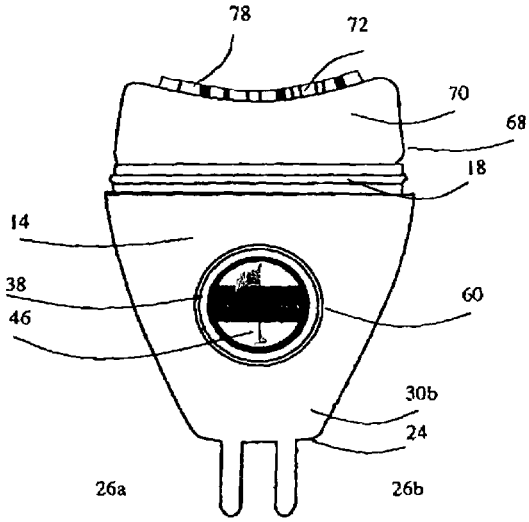
FIG. 5 is a plan view of the multi-purpose golf tool of FIG. 1 with the removable cap section of the tool outer shell removed showing the raised golf ball printing structure showing the curved golf ball printing pad mounted within a curved holding structure adapted for holding an absorbent ink reservoir member in ink transferring connection with the raised golf ball printing structure.
Figure 4:
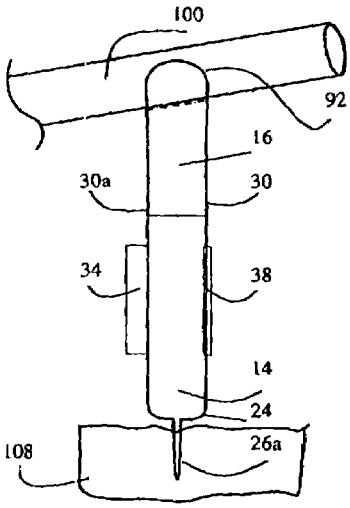
FIG. 4 is a side, plan view of the multi-purpose golf tool of FIG. 1 with the two ground spikes inserted into the ground and a handle of a representative golf club supported above the ground surface by the club handle saddle structure of the removable cap section of the tool outer shell.
Figure 6:
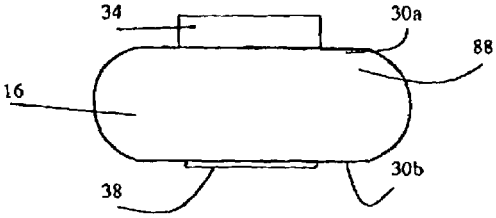
FIG. 6 is a top plan view of the multi-purpose golf tool of FIG. 1.
Figure 7:
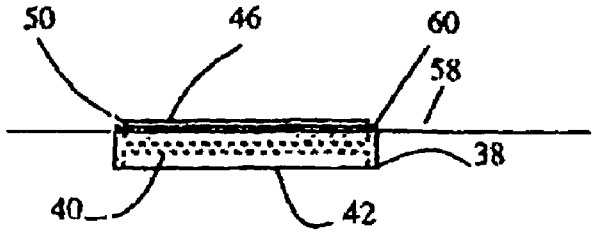
FIG. 7 is a detailed side view of the ball marker magnetically held in place in the ball marker storage structure of the tool outer shell.
Figure 8:
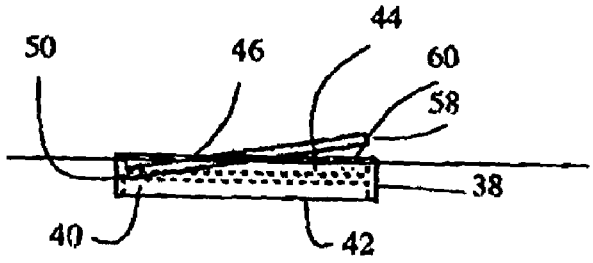
FIG. 8 is a detailed side view of the ball marker with one end pushed into the ball marker storage structure such that the opposite end of the ball marker is raised above the rim of the ball marker storage structure in position for removal of the ball marker when needed for use.

FIGS. 1–8 show various aspects of an exemplary embodiment of the multi-purpose golf tool of the present invention generally designated 10. Multi-purpose golf tool 10 includes an aluminum, two-part, tool outer shell, generally designated 12, including a bottom shell portion, generally designated 14, and an outer shell cap portion, generally designated 16, that is sealably connectable to the bottom shell portion 14 by an O-ring 18 positioned around the circumference of a raised golf ball printing structure 20 that extends from the bottom shell portion 14. Although outer shell 12 is constructed from aluminum in this exemplary embodiment, materials such as substantially rigid plastics, wood, other metals and similar materials are also suitable construction materials.

Bottom shell portion 14 has a bottom end 24 having two ground insertion spikes 26*a*, 26*b* that form a ball mark repair tool. In this embodiment, insertion spikes 26*a*, 26*b* are also formed of aluminum.

The outer sidewall 30 of bottom shell portion 14 has a substantially oblong cross-sectional shape with one side 30*a* having a shell attachment clip, generally designated 34, secured thereto that is adapted to attach tool outer shell 12 to a waistband, a belt, or other suitable attachment structure for easy carrying. The other side 30*b* of outer sidewall 30 has a ring-shaped ball marker storage structure, generally designated 38, that has a magnet 40 positioned on only a portion of the bottom surface 42 of a cylinder-shaped marker receiving cavity 44 of ball marker storage structure 38. Magnet 40 provides a holding force for holding a magnetically attractable ball marker disk 46 securely within marker receiving cavity 44 when it is not in use. Ball marker disk 46 is removed from marker receiving cavity 44 by depressing a lower end of ball marker disk 46 toward bottom surface 42 of cylinder-shaped marker receiving cavity 44. Ball marker disk 46 pivots along the edge 50 of magnet 40 causing the top end 58 of ball marker disk 46 to extend outward past the rim 60 of ring-shaped ball marker storage structure 38 where is easily grasped by the user and removed from marker receiving cavity 44 for use.

The interior of bottom shell portion 14 has a sealable interior cavity 68 formed therein below a raised golf ball printing structure 70 having a curved golf ball printing pad 72 mounted therein. Curved golf ball printing pad 72 has a curve substantially equal to the curved exterior of a golf ball and has multiple raised porous printing surfaces 78 that are in ink receiving connection with an absorbent, ink reservoir member 80 positioned within sealable interior cavity 68. Ink may be added to absorbent, ink reservoir member 80 as needed. An O-ring 18 around the circumference of raised golf ball printing structure 70 forms a seal with the interior wall 86 of outer shell cap portion 16 to keep ink reservoir member 80 from drying out or allowing ink to leak from ink reservoir member 80 onto clothing or other surfaces.

The top surface 88 of outer shell cap portion 16 defines a club handle saddle structure, generally designated 92, that includes a recessed area adapted for supporting the handle 100 of a golf club or putter above the ground surface when the two ground insertion spikes 26*a*, 26*b* are inserted into the ground 108. It can be seen from the preceding description that a multi-purpose golf tool has been provided.

It is noted that the embodiment of the multi-purpose golf tool described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A multi-purpose golf tool comprising:

A tool outer shell having a club handle saddle structure formed therein for supporting a section of a golf club handle on a recessed area of the tool outer shell;

two ground insertion spikes extending from the tool outer shell;

an outer tool shell attachment clip secured to the tool outer shell and adapted to be secured over the edge of a waist band;

a ball marker storage structure carried on the tool outer shell;

an absorbent ink reservoir member contained within a sealable interior cavity within the tool outer shell; and a raised golf ball printing structure having a curved golf ball printing pad mounted within a curved holding structure formed within the tool outer shell that is adapted to hold the curved golf ball printing pad in ink receiving connection with the absorbent ink reservoir member;

the curved golf ball printing pad has a curve that is substantially equal to the curved exterior of a golf ball and has multiple raised porous printing surfaces;

the tool outer shell including a bottom shell portion and an outer shell cap portion sealable connectable to the bottom shell portion by an O-ring positioned around the circumference of the raised golf ball printing structure;

the two ground insertion spikes extending from a bottom surface of the bottom shell portions;

the outer shell cap portion having a top cap surface defining the club handle saddle structure;

the ball marker storage structure including a magnet positioned on only a portion of the bottom surface of a marker receiving cavity of the ball marker storage structure in a manner to provide a holding force for holding a metal ball marker in the ball marker holding structure when it is not in use.

* * * * *